US005817416A

United States Patent [19]

Wichelhaus et al.

[11] Patent Number: 5,817,416

[45] Date of Patent: Oct. 6, 1998

[54] RESIN SOLUTION FOR THE SURFACE TREATMENT OF POLYMERS

[75] Inventors: Jürgen Wichelhaus, Wuppertal, Germany; Serge Rebouillat, Collonges, France; Johannes Andres, Düsseldorf; Werner Gruber, Korschenbroich, both of Germany

[73] Assignees: E. I. du Pont de Nemours and Company, Wilmington, Del.; Henkel, Dusseldorf, Germany

[21] Appl. No.: 979,388

[22] Filed: Nov. 19, 1992

Related U.S. Application Data

[63] Continuation of Ser. No. 503,915, Apr. 4, 1990, abandoned.

[30] Foreign Application Priority Data

Apr. 14, 1989 [DE] Germany ..... 39 12 523.8

[51] Int. Cl.[6] ..... D02G 3/00

[52] U.S. Cl. ..... 428/364; 428/375; 428/394; 428/395

[58] Field of Search ..... 428/395, 375, 428/394, 364; 8/115.51, 115.6, 115.54; 252/868.8; 524/314, 315, 321, 514; 525/301, 304, 308, 309, 183, 184

[56] References Cited

U.S. PATENT DOCUMENTS

| | | | |
|---|---|---|---|
| 3,473,956 | 10/1969 | McIntyre | 428/267 |
| 4,173,680 | 11/1979 | Vachon et al. | 428/394 |
| 4,305,865 | 12/1981 | Okada et al. | 525/183 |
| 4,336,171 | 6/1982 | Kohlstadt et al. | 524/510 |
| 4,483,962 | 11/1984 | Sadowski | 524/818 |
| 4,557,967 | 12/1985 | Willemsen et al. | 428/224 |
| 4,720,398 | 1/1988 | van Aalten | 427/208.2 |
| 4,764,291 | 8/1988 | Steltenkamp et al. | 252/8.8 |
| 4,791,164 | 12/1988 | Wichelhaus et al. | 524/514 |
| 4,849,476 | 7/1989 | Mashita et al. | 525/183 |
| 4,992,500 | 2/1991 | Klauck et al. | 524/270 |
| 5,013,786 | 5/1991 | Payne et al. | 524/514 |
| 5,047,479 | 9/1991 | Ohmae et al. | 525/183 |
| 5,107,069 | 4/1992 | Wichelhaus et al. | 524/514 |

FOREIGN PATENT DOCUMENTS

| | | | |
|---|---|---|---|
| 161373 | of 0000 | European Pat. Off. . | |
| 51-038600 | 3/1976 | Japan | 252/8.8 B |
| 62-149980 | 7/1987 | Japan | 428/395 |
| 1440810 | 6/1976 | United Kingdom | 525/184 |

*Primary Examiner*—Marion E. McCamish
*Assistant Examiner*—J. M. Gray

[57] ABSTRACT

The processability of polymer fibers, and more specifically of aramid fibers, was intended to be improved. This object was attained by the use of resin solutions or dispersions of resins in an organic solvent containing 0.2 to 20 percent by weight of at least one polyamide resin based on long-chain branched dicarboxylic acids and having terminal carboxylic and/or amino groups, 0.02 to 10 percent by weight of a copolymer compatible therewith and containing carboxylic acid and/or carboxylic acid anhydride groups and carboxylic acid esters, 0 to 5 percent by weight of further auxiliary materials, and organic solvents to make 100 percent by weight for the surface treatment of polymer fibers.

17 Claims, No Drawings

RESIN SOLUTION FOR THE SURFACE TREATMENT OF POLYMERS

This is a continuation of application Ser. No. 07/503,915 filed Apr. 4, 1990 now abandoned.

The invention proposes the use of solutions containing polyamide resins, on the one hand, and polymers bearing acid groups, on the other hand, for coating polymer fibers prior to the final processing thereof.

Fibers for the purpose of the invention are understood to be both continuous filaments and staple fibers, fiber tows, yarns, pulps and the like, as well as flat textile fabrics, be they woven, knitted, machine-knitted or by other means bonded, for example as non-wovens.

Reinforcement of synthetic materials with organic or inorganic fibers is known to produce better material properties. The tensile strength at break of such composite materials or other mechanical properties is increased as a function of the quantity of incorporated fiber. Nevertheless, it has been shown that the full performance capability of the fibers cannot be used in many instances, because fracture occurs in connection with the breaking process at the interface of the fiber with the matrix and the fibers, so to speak, are pulled out of the matrix. Such phenomena are seen particularly with very high tensile strength fibers, for example, aramid fibers.

To prevent these, fibers are coated in practice with surface treatment agents, for example, epoxide resin preparations or with other resins. Examples are described in U.S. Pat. No. 4,557,967 and U.S. Pat. No. 4,652,488. However, for many industrial uses, the resulting improvements in fiber adhesion capability in the matrix are still not adequate. Furthermore, the treatment of the fibers with epoxides results to some extent in embrittlement so that the treated fibers can break or splay in subsequent textile processing steps, such as knitting or weaving; furthermore, the water absorption by the fiber is increased.

Further known are polyamide resins based on dimer fatty acid and the admixtures of such resins with copolymers bearing carboxylic acid groups. Thus, the German Laid-Open Patent Application 35 04 804 describes a melt adhesive from polyamides based on dimerized fatty acids, aliphatic amines and modifying additives, on the one hand, and copolymers of ethylene, on the other hand, wherein additionally from 5 to 95% by weight, based on the total mixture, of a copolymer of ethylene, the inner anhydride of an ethylenically unsaturated dicarboxylic acid and optionally (meth)acrylic acid esters and/or vinyl esters is contained. The copolymers preferably consist of from 50 to 90% by weight of ethylene, from 5 to 30% of (meth)acrylic acid esters of aliphatic linear or branched primary $C_1$–$C_{18}$ alcohols and from 2 to 30% by weight of the inner anhydride of a polymerizable carboxylic acid.

The resin mixtures described in this Laid-Open Patent Application are used as melt adhesives, although it has been mentioned that the substances may be applied as a solution as well. However, there is not found any reference to that such solutions are advantageously suitable for treating the surface of polymer fibers.

In industrial practice it is desirable to have available surface treatment agents for polymer fibers, and more particularly aramid fibers, which agents cause improved flexibility properties and improved sliding properties to be obtained of the fibers during and after processing and, thus, improve the fiber-to-fiber friction, the formation of deposits during processing and in some applications also the water absorption by the fibers.

Therefore, it is one object of the present invention to provide coated polyamide fibers, and especially aromatic polyamide fibers (aramid fibers) which exhibit an improved processability in knitting and weaving processes, in combination with an increased resistance to material fatigue. Furthermore, the fiber composites are intended to absorb lower amounts of water. It is a further object of the invention to provide an aromatic polyamide fiber coated with a surface treatment agent which can be employed for most of the known applications without additional treatment steps. More specifically, it is the object of the invention to propose the use of a resin solution for treating the surfaces of polymer fibers which resin solution produces these beneficial results.

It is a further object of the invention to provide a coated fibrous polyamide material, and more specifically a fibrous aromatic polyamide material, which has an improved bonding property to other substrates such as, for example, rubber, and exhibits a satisfactory textile processability and has an excellent material fatigue resistance. It is a further object of the invention to provide a process for the preparation of such fibrous polyamides wherein the coating with the surface treatment agent may occur on the never-dried fiber (on line) or on the dried fiber (off line).

Accordingly, the subject of the invention is the use of resin solutions or dispersions of resins in an organic solvent containing

- 0.2 to 20 percent by weight of at least one polyamide resin based on long-chain branched dicarboxylic acids and having terminal carboxylic and/or amino groups,
- 0.02 to 10 percent by weight of a copolymer compatible therewith and containing carboxylic acid and/or carboxylic acid anhydride groups and carboxylic acid esters,
- 0 to 5 percent by weight of further auxiliary materials, and
- organic solvents to make 100 percent by weight for the surface treatment of polymer fibers.

The resin solutions used according to the invention contain, as one of the two major constituents, a polyamide resin based on long-chain branched dicarboxylic acids, and more specifically those based on dimer fatty acid. Such polyamide resins are produced in accordance with known processes by the condensation of polyfunctional dicarboxylic acids with polyfunctional amino compounds, if so desired in the presence of aminocarboxylic acids or of monocarboxylic acids. Preferred are polyamide resins wherein the dimer fatty acid comprises a substantial proportion, i.e. more than one third of the total amount of the acid components. High proportions of dimer fatty acid produce a beneficial result with respect to the fatigue strenght. Here the term "dimer fatty acid" is understood to mean the commercially available dimerization products of unsaturated fatty acids. These are mixtures which may contain mono-, di- and tricarboxylic acids, wherein the proportion of dicarboxylic acids is to be rated as higher than 80% by weight, and preferably higher than 90% by weight.

Particularly suitable are dimer fatty acids obtained by the dimerization of $C_{18}$ fatty acids and preponderantly contain 36 carbon atoms. In addition, dimer fatty acids having shorter chains or longer chains, as much as they are available, can also be used.

As the further acid component there may be contained in the polyamide resins according to the invention aliphatic dicarboxylic acids having from 6 to 22 carbon atoms. Preferred are here saturated dicarboxylic acids having from 6 to 12 carbon atoms, and especially linear dicarboxylic acids having terminal carboxylic groups. Thus, more particularly, adipic acid, heptanedicarboxylic acid, octanedicarboxylic acid, azelaic acid, nonanedicarboxylic acid, sebacic acid, undecanedicarboxylic acid, dodecanedicarboxylic acid and/or brassylic acid as well as the higher homologues thereof are suitable. The following is applicable to the selection of the kind and amount of the dicarboxylic acids:

If polyamide resins having a lower melting point are intended to be obtained, then the artisan will not employ any aliphatic dicarboxylic acids having from 6 to 22 carbon atoms or only low amounts of such acids. If high melting points are demanded, then higher proportions of such dicarboxylic acids are employed within the given molar amount, that is particularly those having shorter chains, such as adipic acid.

As the amine components there may be contained in the polyamide resins employed according to the invention aliphatic, aromatic and/or cyclic diamines having from 2 to 36 carbon atoms and selected from the class comprising di-primary diamines, diamines containing secondary amino groups comprising alkyl substituents having not more that 25 carbon atoms at the N atom and/or heterocyclic diamines twice capable of forming amides. Preferred are diamines having from 2 to 20 carbon atoms, and more specifically lower straight-chain or branched-chain aliphatic or monocyclic di-primary diamines or monocyclic or heterocyclic diamines. The diamines here to be taken into consideration may be subdivided in various groups. Of great importance are, for example, the di-primary aliphatic diamines having terminal amino groups. Among these, amines are preferred which in their carbon backbones conform to the above-identified dicarboxylic acids including dimer fatty acids, and the shorter-chain homologues of such diamines. Thus, important diamines in detail are ethylene diamine, propylene diamine, hexamethylene diamine and the homologues thereof as well as dimer fatty diamine (preparable by the conversion of dimer fatty acids in the dinitriles and subsequent hydrogenation of the two nitrile groups). A further group of diamines consists of aromatic diamines. There may be employed aromatic diamines derived from benzene, toluene or other substituted aromatics, for example 2,6-toluylene diamine, 4,4'-diphenylmethanediamine and/or xylylene diamine. The analogue cyclohexane derivatives may further be employed.

A further class of diamines that can be used in the polyamide resins according to the invention is that comprising the diamines containing one or two secondary amino groups having an alkyl substituent of not more than 8 carbon atoms at the N atom. Such diamines are derived from the previously mentioned di-primary aliphatic diamines and have a short-chain alkyl substituent at the N atom, especially methyl, ethyl or propyl.

A further group of diamines that can be used in the polyamide resins according to the invention is that comprising the heterocyclic diamines capable of twice forming amides. These preferably are aliphatic heterocycles. The most important representative of this group is piperazine.

The polyamide resins used according to the invention may portionwise contain, as a further component, aliphatic diamines which have been N-alkyl-substituted on at least one side, which are twice capable of forming amides and which have from 2 to 10 carbon atoms and 10 to 25 carbon atoms in the straight-chain or branched N-alkyl residue. The basis structure of these amines may be derived from the above-mentioned aliphatic di-primary diamines. Said basis structure preferably is not branched, that means, more specifically, it is ethylene diamine, propylene diamine, tetramethylene diamine, pentamethylene diamine, hexamethylene diamine or the higher homologues thereof, which comprise an alkyl residue having 10 to 25 carbon atoms on at least one of the N atoms.

The alkyl residue present on at least one of the N atoms contains from 10 to 25 carbon atoms; it may be linear, branched or cyclic, however with straight-chain residues being preferred. Among the straight-chain residues, in turn, there are preferred those having an even number of carbon atoms. The diamines capable of a double amide formation and being N-alkyl substituted on at least one side thereof may be employed as a defined substance. However, it is preferred here to employ mixtures. Thus, products are preferred to be used, the N-alkyl moiety of which has the chain length and chain length distribution of a hydrogenated fatty acid mixture. Particularly preferred N-alkyl-substituted aliphatic diamines comprise N-alkyl substituents, the chain-length of which is that of a hydrogenated tallow fatty acid or of a hydrogenated tall oil fatty acid.

As an alternative or as a further amine component, the polyamide resins used according to the invention may contain polyether diamines. These are compounds having two terminal primary amino groups and a polyether chain located therebetween having at least one ether bond in the chain.

As typical representatives of the polyether diamines, there may be mentioned bis-(3-aminopropyl)-poly-oxypropylenes and bis-(2-aminopropyl)-polytetrahydrofuranes having a molecular weight between about 500 and 5,000. The representatives as particularly mentioned here are preferred because they are readily available. Of course, polyethers composed of polymeric, optionally branched-chain butanediols, pentanediols and hexanediols having two terminal amino groups are also usable. Mixed ethers having two terminal amino groups could also be used. Also non-polymeric etherdiamines, i.e. those containing just one or a few ether group(s) may be used.

In addition, the polyamide resins employed according to the invention may contain aminocarboxylic acids. Here, products having a terminal amino group and a terminal carboxylic group connected through a straight carbon chain having from 3 to 13 carbon atoms are preferred. Moreover, aminoalcohols may be present in the polyamide resins according to the invention in addition to or in the place of the diamines.

Typical polyamide resins used according to the invention have the following composition:

a) 35 to 49.5% by mole of dimeric fatty acid and b) 0.5 to 15% by mole of monomeric fatty acid having a chain length of from 12 to 22 carbon atoms and c) 2 to 35% by mole of polyether diamines having the general formula

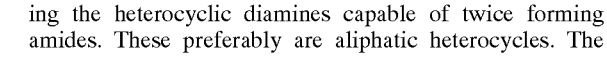

$$H_2N—R_1—O—(RO)_x—R_2—NH_2,$$

wherein x represents a number between 8 and 80, and more particularly between 8 and 40, $R_1$ and $R_2$ are same or different and represent aliphatic and/or cycloaliphatic hydrocarbon moieties and R represents an, optionally branched, aliphatic hydrocarbon moiety having from 1 to 6 carbon atoms, and d) 14 to 48% by mole of aliphatic diamines having from 2 to 40 carbon atoms in the carbon backbone, wherein up to ⅔of the dimeric fatty acids can be replaced by aliphatic dicarboxylic acids having from 4 to 12 carbon atoms.

Other preferred products have the following composition:

a) 25 to 50% by mole of dimer fatty acids, b) 0 to 25% by mole of aliphatic dicarboxylic acids having from 6 to 22 carbon atoms, c) 25 to 45% by mole of aliphatic, aromatic and/or cyclic diamines having from 2 to 40 carbon atoms from the class of the di-primary diamines, the diamines containing secondary amino groups and comprising alkyl substituents having not more than 8 carbon atoms at the N atom and/or of the heterocyclic diamines capable of double amide formations, d) 5 to 25% by mole of diamines which have been N-alkyl-substituted on at least one side and are capable of double amide formation, having from 2 to 10 carbon atoms, and 10 to 25 carbon atoms between the N atoms and 10 to 25 carbon in the straight-chain oder branched N-alkyl residue or also a) 20 to 55% by mole of dimer fatty acids, b) 0 to 25% by mole of aliphatic dicarboxylic acids having from 6 to 22 carbon atoms, c) 0 to 30% by mole of aminocarboxylic acids and/or the lactams thereof having from 6 to 22 carbon atoms, d) 22 to 55% by mole of aliphatic, aromatic and/or cyclic diamines having from 2 to 40 carbon atoms from the class of the di-primary diamines, the diamines containing secondary amino groups and comprising alkyl substituents having not more than 8 carbon atoms at the N atom and/or of the heterocyclic diamines capable of double amide formations, e) 0 to 30% by mole of polyetherdiamines and f) 0 to 30% by mole of aminoalcohols.

Nevertheless, mixtures of such polyamides may be employed as well.

The polyamide resins employed according to the invention may contain acid components and amine components (which also include the aminoalcohols) in stoichiometric amounts. However, for the use as a surface treatment agent it is desired in the predominant number of cases that there are present remaining amino groups or remaining acid groups. In order to accomplish this, the artisan will employ an excess of acid or of base, while said excess, however, would not exceed 10 equivalent percent of all functional groups. Base-terminated resins have amine numbers of up to about 50, and preferably of from 2 to 20 and especially of from 2 to 15. Acid-terminated resins should have an acid number within the range of up to about 20, and preferably of from 2 to 10.

The polyamide resins used according to the invention have a molecular weight (number average) within the range of from 5,000 to 40,000, and preferably from 8,000 to 12,000. The artisan, in order to attain high molecular weights, will employ the acid and base components in equivalent amounts, if possible, whereas an excess of one component may be employed, if lower molecular weights are intended to be obtained. A further possibility of reducing the molecular weight is the addition of chain-terminating agents such as monofunctional fatty acids or monofunctional amines. On the other hand, the molecular weight may be increased by a certain amount of trifunctional components, such as trimer fatty acid.

The copolymers containing carboxylic acid groups or carboxylic acid anhydride groups as used in combination in the resin solutions employed according to the invention are copolymers of polymerizable olefins with polymerizable carboxylic acids and/or carboxylic acid anhydrides and/or the polymerizable esters of carboxylic acids. For example, usable are copolymers from ethylene with proportionate use in combination of propylene together with the esters of acrylic aid and/or methacrylic acid and/or maleic anhydride. Further suitable are copolymers based on butylmaleic anhydride or the adducts of maleic anhydride to polydienes, e.g. the adducts of maleic anhydride to polybutadiene.

The artisan, when selecting a suitable copolymer, will have to pay attention to compatibility. Compatibility here is intended to mean that upon melting the blend of the polymers no macroscopically observable phase separation will occur.

The copolymers of a preferred class in the main consist of ethylene, while part of the ethylene may have been replaced by propylene. Thus, 15% of propylene, based on ethylene, may be present. Suitable copolymers have compositions within the following range:

50 to 90% by weight of ethylene, 5 to 30% by weight of (meth)acrylic acid esters of primary aliphatic linear or branched alcohols having from 1 to 18 carbon atoms, and 2 to 30% by weight of the inner anhydride of a polymerizable carboxylic acid.

Here, cyclic anhydrides such as maleic anhydride, itaconic anhydride and the like are preferred. Maleic anhydride is of particular importance. Among the esters of (meth) acrylic acid, there are of particular importance the methyl, ethyl, propyl, butyl, 2-ethylhexyl esters and the esters with so-called fatty alcohols having from 12 to 18 carbon atoms, which alcohols may also be unsaturated. Moreover, part of the (meth)acrylic esters may also be replaced by esters of the vinyl-alcohol, for example vinyl acetate or vinyl esters of $C_3$- to $C_{18}$-carboxylic acids.

According to a particularly preferred embodiment of the invention, copolymers are employed which comprise 80 to 90% by weight of ethylene, 5 to 15% by weight of the above-mentioned esters of (meth)acrylic acid, and 2 to 5% by weight of the unsaturated anhydride, preferably maleic anhydride.

The copolymers preferably have a molecular weight (weight average) of from about 50,000 to 250,000. In general, for the preparation of the polymers to be used according to the invention, lower proportions are employed in the case of a longer-chain alcohol moiety of the acrylic ester and the methacrylic ester.

In addition, the resin solutions used according to the invention may contain further auxiliary materials. Said auxiliary materials include stabilizers in the broadest sense, i.e. UV stabilizers or anti-ageing agents. Further auxiliary materials are, for example, dyes or also processing aids.

The solids content of the resin solutions employed according to the invention is from 0.5 to 40% by weight, and preferably 5 to 15% by weight.

The resin solutions employed according to the invention are not in any case true physical solutions. Portions of the polymers mixed with each other may be present also in the dispersed swollen or unswollen state without disadvantage for the properties. In such case settling is to be prevented during application. The usable solvents include the conventional solvents for polyamides based on dimer fatty acid such as, e.g., mixtures comprising $C_1$- to $C_{12}$-alcohols, especially $C_1$- to $C_4$-alcohols, preferably in admixture with hydrocarbons. A particularly favourable solvent system consists of isopropanol and toluene, for example in a ratio by weight of 9:1.

According to the invention, coated polymer fibers of the most various types can be produced. Thus, more particularly, coated fibers of organic polymers, that is of polymerizates as well as of polycondensates, can be prepared. Especially important coated fibers are fibers from polyamides, polyesters, polyimides and/or polyethers, namely based on aromatic and/or aliphatic units. Coated fibers from aromatic polyamides are especially important.

Within the scope of the invention, special significance is attributed to coated aromatic polyamide fibers. Among aromatic polyamide fibers, fibers (continuous filaments, short staple fibers, tow, yarns, pulps, fiber mixes, fibers having a specific surface texture and the like or flat textile fabrics) from aromatic polyamides with fiber type structure are generally considered. Aromatic polyamides are understood to be such polymers that are partially, preponderantly or exclusively composed of aromatic rings, which are connected through carbonamide bridges and optionally, in addition, also through other bridging structures. The structures of such aromatic polyamides can be elucidated in part by the following general formula: $(—CO—NH\ A_1—NH—CO—A_2)_n$, wherein $A_1$ and $A_2$ signify aromatic and/or heterocyclic rings, that can also be substituted. An important class of surface-treated fibers of the invention is derived from wholly aromatic copolyamides.

Examples of such aromatic polyamides are poly-m-phenylene isophthalamide with the trademark Nomex(®) (U.S. Pat. No. 3,287,324); poly-p-phenylene terephthalamide with the trademark Kevlar® (DE 22 19 703). Further suitable polyamides are those having structures in which at least one of the phenyl radicals bears one or more substituents, for example, lower alkyl groups, alkoxy groups or halogen atoms. Further aromatic polyamides contain, to some extent at least, repeating units that are derived from 3- or 4-aminobenzoic acid, respectively.

Additionally suited for finishing with the surface treatment agent of the invention are such wholly aromatic polyamide fibers that have been stretched in a nitrogen atmosphere at a temperature above 150° C. according to DE 22 19 646.

Further suitable are also aromatic polyamides containing diaminodiphenylene groups in which two phenyl radicals each bearing an amino or carboxylic acid group are connected together through a bridging structure, for example, a heteroatom (O, S, $SO_2$, NR, $N_2$ or a $CR_2$ group, with R=H or alkyl groups) or a CO group. Finally, also suitable are aromatic polyamides in which the aromatic rings are partially replaced by heterocycles or the heterocycles participate as substituents or chain members, as well as fibers from U.S. Pat. No. 4,075,172 marketed under the trademark Technora®.

The surface treatment agents according to the invention may be employed in various stages of the fiber production. Thus, the surface treatment agents may be applied onto the never dried moist fiber (on line), or they may be applied onto the dried fiber (off line). It is preferred that the surface treatment agents are applied after drying and, if desired, after drawing. This is in particular applicable to aramid fibers.

For the application onto the fiber the conventional application means can be employed. These include, for example, metering coating systems, roller-coating systems or baths.

Prior to, during or after the application an ultrasonic treatment, an electrostatic treatment or a plasma treatment of the fiber or of the yarn may be carried out. In some cases this will be preferred to improve the penetration of the treatment agent. At all events the suitable equipment as common for the use with solvent-containing formulations may be employed here. The add-on amount to the fiber is from 0.01 to 12% by weight, based on the fiber weight.

The fiber may be dried before or after coating and may optionally also be coated with several layers, i.e. be dried after a first coating step and then once more be coated in a further bath. The drying process may be carried out by employing convection (for example hot air), heat conduction (e.g. contact drying), radiation (e.g. infrared) or the like. The heat treatment of the fiber is usually conducted within a range of from 80° C. to 220° C., while the higher temperatures within said range can be employed only with thermally stable fibers, for example with aramid fibers. The time of drying may vary from a few seconds to several minutes, dependent on the degree of drying to be attained and on the further intended use of the fiber. The running speed of the fiber or yarns in the coating apparatus may be selected between a few meters per minute and some hundreds of meters per minutes, dependent on the desired amount of product uptake. A lower limit of the drying is about 5 seconds, an upper limit of the running speed is about 825 m/min.

The fibers surface-modified according to the invention are useful for a variety of applications. For example, in cold-setting adhesion procedures they exhibit an improved substrate adhesion; however, they may also be embedded in synthetic materials (plastics) or included by vulcanization in rubber, whereupon the fibers exhibit an improved binding power to polar as well as apolar rubber types.

EXAMPLES

The starting materials were a polyamide resin of the following composition

TABLE 1

| Polyamide | A |
|---|---|
| Polymeric fatty acid (Mono 1%; Dim. 95%, Trim. 4%; FSI | 265.0 |
| Stearic acid | 19.9 |
| Diaminoethane | 27.7 |
| Bis-(3-aminopropyl)-poly-tetrahydrofurane (MW 1,100) | 41.2 |
| Piperazine | — |
| Bis-(2-aminopropyl)-poly-propylene oxide (MW 2,000 | — |
| Amine value | 1.0 |
| Acid value | 7.6 |

a terpolymer of the following composition:

| | |
|---|---|
| Ethylene content | 91% by wt. |
| Acrylic acid ethyl ester | 6% by wt. |
| Maleic anhydride | 3% by wt. |
| Molecular weight ($M_W$) | 45,000 to 50,000 |
| Viscosity at 190° C. | 87,000 mPa.s |
| Softening range | 80° C. to 100° C. |

and a copolymer from ethylene and an organic acid, said polymer having an acid value of 60 and a melt index of 35 {Product Nucrel® of the company Du Pont}.

Eight parts by weight of polyamide and one part of each of the copolymers were melt-blended, and the homogenated melt was processed with a mixture of 8 parts of isopropanol and 1 part of toluene to make a solution of 10% by weight. The resulting solution was turbid, i.e. it contained dispersed portions.

Test Results with Aramid Fibers

A continuous filament aramid fiber of the p-phenylenediamine terephthalamide type in the dried (off line) condition was passed through a bath containing the surface treatment agent described above according to the invention and then dried at about 120° C. The yarn had a pre-tension of 0.6 daN. It was an untwisted 1670 dtex yarn. The yarn was advanced through the immersion bath at a speed of about 30 m/min. The solids uptake from the treatment bath was 2 to 3 percent by weight (after drying).

The moisture uptake under Standard Conditions was measured of the yarns thus treated. It was found to be 7.5% by weight for an untreated aramid yarn (Kevlar® 29), 2.8% by weight for the yarn treated according to the invention, and 5.8% by weight for an equal yarn having a conventional epoxide coating.

Knitting Trials with Treated Yarns

In introductory tests the coefficient of friction of treated yarns was determined for comparison to that of untreated yarns. The measurement was carried out in a friction measuring apparatus (Rothschild) according to Standard Conditions. The coefficient of friction yarn-to-metal was 0.40 for the treated yarn and 0.54 for the untreated yarn.

Aramid yarns (Kevlar®) were knitted on an ELHA® circular knitting machine (Model RRU). The test lasted 4 hours. The machine speed was 670 $min^{-1}$ and the knitting speed was 15 m/min. In contrast to untreated fibers, no wear was observed. The structure of the knitted goods was uniform. Furthermore, no deposits were formed on the knitting machine. This means that the surface treatment agent of the invention clearly improved the knittability of aramid yarns.

We claim:

1. A coated organic polymer fiber wherein the coating consists essentially of a solution or dispersion of resins in an organic solvent, the resins comprising 0.2 to 20 percent by weight of the solution or dispersion of at least one polyamide resin based on long-chain branched dicarboxylic acids having terminal groups selected from the group consisting of carboxylic and amino groups, and 0.2 to 10 percent by weight of the solution or dispersion of a copolymer compatible therewith and containing a member selected from the group consisting of carboxylic acid, carboxylic acid anhydride and carboxylic acid esters.

2. A coated fiber of claim 1 wherein the total solids content of the coating is from 0.5 to 40% by weight.

3. A coated fiber of claim 1 wherein the polyamide resin consists of an acid component having from 2 to 14 carbon atoms selected from the group consisting of dimer fatty acids, carboxylic acids and aminocarboxylic acids and an amino component having from 2 to 36 carbon atoms selected from the group consisting of diamines and aminoalcohols.

4. A coated fiber of claim 1 wherein the polyamide resin contains an ether diamine.

5. A coated fiber of claim 4 wherein the ether diamine has a primary amino group and a secondary amino group bearing a substituent having from 1 to 25 carbon atoms.

6. A coated fiber of claim 5 wherein the copolymer is selected from the group consisting of:

styrene copolymerized with maleic anhydride; and a member selected from the group consisting of ethylene and propylene copolymerized with an ester of a compound selected from the group consisting of acrylic acid, methacrylic acid and maleic anhydride.

7. A coated fiber of claim 6 wherein the total solids content of the coating is from 0.5 to 40% by weight and the solvent is an alcohol of from 1 to 10 carbon atoms.

8. A coated fiber of claim 5 wherein the copolymer is an adduct of maleic anhydride and an unsaturated polydiene.

9. A coated fiber of claim 8 wherein the total solids content of the coating is from 0.5 to 40% by weight and the solvent is an alcohol of from 1 to 10 carbon atoms.

10. A coated fiber of claim 4 wherein the copolymer is selected from the group consisting of:

styrene copolymerized with maleic anhydride; and a member selected from the group consisting of ethylene and propylene copolymerized with an ester of a compound selected from the group consisting of acrylic acid, methacrylic acid and maleic anhydride.

11. A coated fiber of claim 10 wherein the total solids content of the coating is from 0.5 to 40% by weight and the solvent is an alcohol of from 1 to 10 carbon atoms.

12. A coated fiber of claim 4 wherein the copolymer is an adduct of maleic anhydride and an unsaturated polydiene.

13. A coated fiber of claim 12 wherein the total solids content of the coating is from 0.5 to 40% by weight and the solvent is an alcohol of from 1 to 10 carbon atoms.

14. A coated fiber of claim 1 wherein the copolymer comprises a polymer of an olefin and a member selected from the group consisting of unsaturated carboxylic acid esters and carboxylic acid anhydrides.

15. A coated fiber of claim 1 wherein the copolymer is selected from the group consisting of:

styrene copolymerized with maleic anhydride; and a member selected from the group consisting of ethylene and propylene copolymerized with an ester of a compound selected from the group consisting of acrylic acid, methacrylic acid and maleic anhydride.

16. A coated fiber of claim 1 wherein the copolymer is an adduct of maleic anhydride and an unsaturated polydiene.

17. A coated fiber of claim 1 wherein the solvent is an alcohol of 1 to 10 carbon atoms.

* * * * *